United States Patent [19]

Selwyn

[11] Patent Number: 4,677,010

[45] Date of Patent: Jun. 30, 1987

[54] NAUTICAL HIGH VISIBILITY DEVICE

[76] Inventor: Stephen Selwyn, 1511 Brightwater Ave., Brooklyn, N.Y. 11235

[21] Appl. No.: 824,380

[22] Filed: Jan. 31, 1986

[51] Int. Cl.[4] ..... B44F 1/02; G09F 3/10

[52] U.S. Cl. ..... 428/40; 40/2 R; 114/103; 428/187; 428/325; 428/690

[58] Field of Search ..... D12/317; 114/103; 40/2 R; 428/40, 187, 325, 690

[56] References Cited

U.S. PATENT DOCUMENTS 3,928,226 12/1975 McDonough et al. ..... 428/916 X
3,936,567 2/1976 Vesely ..... 428/40 X
3,986,722 10/1976 Patterson ..... 114/103 X
4,008,115 2/1977 Fairbanks et al. ..... 428/41 X
4,048,736 9/1977 Castleman et al. ..... 428/500 X
4,511,616 4/1985 Pitts et al. ..... 428/187 X

OTHER PUBLICATIONS

P. 135 of the Mar. 1963, Popular Mechanics.

*Primary Examiner*—Henry F. Epstein
*Attorney, Agent, or Firm*—Handal & Morofsky

[57] ABSTRACT

A detection device comprising cooperating retro-reflective and fluorescent members are disposed on a self-adhesive incorporating a conductive metal radar reflecting layer. Nautical application to the sails of sail-boats and the like are disclosed.

15 Claims, 2 Drawing Figures

NAUTICAL HIGH VISIBILITY DEVICE

TECHNICAL FIELD

The invention relates to high visibility numerical or other indicia particularly useful on sails of boats and exhibiting high visibility and/or detectability during daylight and darkness conditions in response to a variety of stimuli.

BACKGROUND ART

With the increasing popularity of nautical and other sports there has been a growing need for devices which improve visibility. The need is particularly acute during darkness and/or fog conditions. In response to this need a number of devices have evolved. These devices include retroreflective plastic prismatic members mounted on bicycles, and high visibility garments having fluorescent pigments, such as those used by hunters.

In addition to fluorescent pigments and prismatic retroreflective devices, there have also evolved retroreflective pigments which incorporate glass beads. Such pigments are used, for example, in highway stripes and in making other retroreflective materials. Generally, such pigments are referred to as "white" (which means an absence of pigment) or, in other words, substantially only retroreflective glass beads in a carrier material, or, in the alternative, some retroreflective pigments are referred to as "colored" and incorporate some color pigment to give the retroreflective lettering, for example, some contrast during daylight. This compares with white retroreflective materials which suffer from contrast problems in daylight. The solution is to introduce a pigment into the retroreflective material to increase contrast in daylight. However, this solution creates another problem, namely, the reduction of the retroreflectivity of the pigment which is particularly critical during darkness.

In the case of nautical applications, further complications are introduced. In particular, regardless of the illumination during the day or the night, the tendency to severe fog conditions over the water makes dependence on such devices dangerous.

As a consequence of the importance of detection of another craft during foggy conditions, craft, in the last few years in particular, have widely adopted the use of radar in order to detect objects on the water that may pose a threat of collision. It is noted that this threat is particularly acute in the case of sailboats which move over the water without the noise of engines. Unfortunately, however, many small sailboats are made of fiberglass, wood, and other materials which are substantially radar transparent. In view of the fact that the occupants of the craft are also radar transparent, radar is substantially unable to detect the presence of these smaller and silent craft, posing a serious danger to those on the water.

As discussed above conventional products fail to solve the problem posed above. In particular, fluorescent pigments and devices fail to give the required reflectivity at night. Retroreflective materials fail to provide the desired visibility in clear daylight, and none of these devices provides the desired degree of detectability during fog conditions. Finally, such materials tend to mar the appearance of the vessel.

DISCLOSURE OF INVENTION

The invention, as claimed, is intended to provide a remedy. It solves the problem of how to provide a device capable of high visibility during daylight and darkness conditions whether or not there is fog. The device is highly visible to light during the dark hours, exhibits high reflectivity and contrast during daylight conditions and is radar-reflective, providing visibility during foggy weather conditions. In addition, the above is achieved and may be applied to a sail without marring the appearance of the sails of the boat with extraneous markings.

In particular, sailboats are generally required to have some alpha-numerical indicia indicating their identity. In accordance with the present invention, these indicia are made in a manner which result in their being highly durable, inexpensive, highly contrasting under daylight and highly retroreflective during the evening hours, as well as radar-reflective for detection during foggy weather conditions.

The same is achieved through the employment of a multi-layer structure including protective transparent, retroreflective, radar reflective, and fluorescent materials disposed in such a manner that each of these materials operate without interferring with the others. In particular, in accordance with the preferred embodiment of the invention, a retroreflective layer is mounted on an adhesive backing and has disposed thereon fluorescent markings which together with the white retroreflective layer give high visibility during daylight conditions. During darkness the retroreflective layer provides the desired degree of reflectivity. In addition, underneath the retroreflective layer a radar-reflective material is disposed. The retroreflective or fluorescent layer may take the form of alphanumerical designations which are typically used, for example, on the sail of a vessel thus avoiding marring of the sails with unnecessary markings.

BRIEF DESCRIPTION OF DRAWINGS

Several ways of carrying out the invention are described below in detail with reference to drawings which illustrate only specific embodiments of the invention, in which.

DETAILED DESCRIPTION

Figure 1:
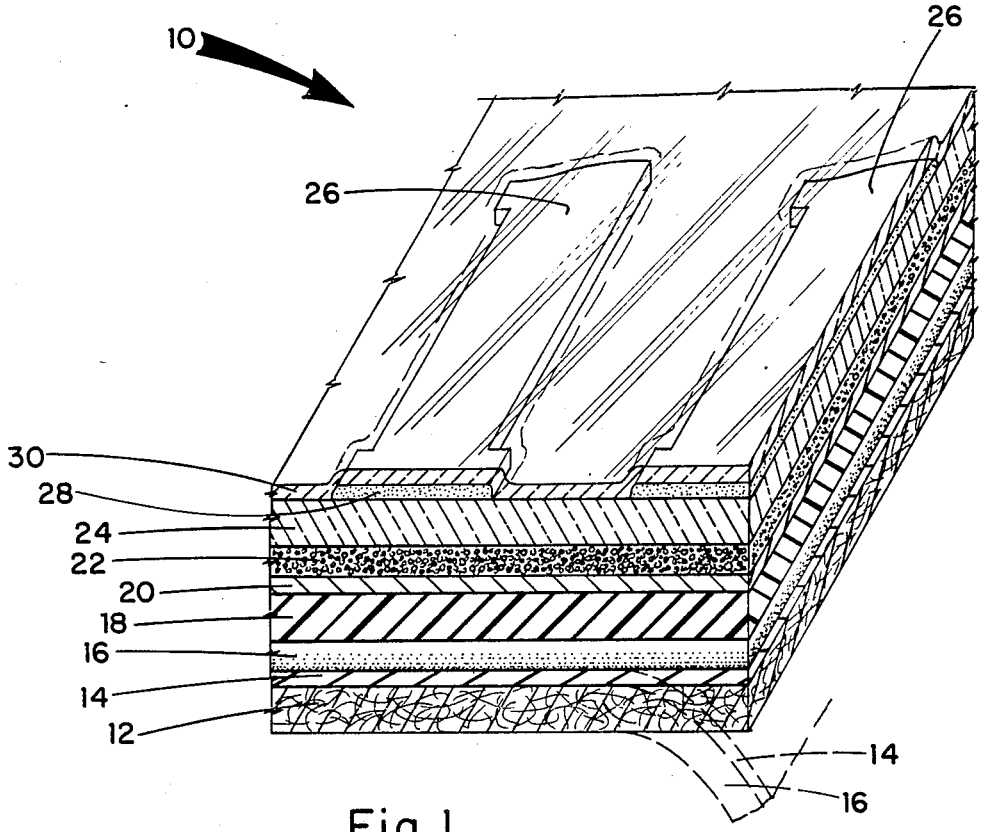
FIG. 1 is a partial perspective view, partially in cross-section of a device constructed in accordance with the present invention.

Referring to FIG. 1, high visibility material 10 constructed in accordance with the present invention is illustrated. In illustrating this material, the thickness of the various layers, in cross-section, has been greatly exaggerated in order to illustrate its structure and composition. Naturally each of the layers illustrated have thicknesses on the order of several thousands of a centimeter and the alpha numeric indication has a height of about ten centimeters.

Material 10 comprises a backing material 12 which may be made of paper or any other suitable flexible material capable of holding a release agent 14, such as wax. Release agent 14, in turn, is in removable engagement with adhesive layer 16. The other surface of adhesive 16 is, in turn, securely engaged to layer 18 of polymeric material such as that marketed by the DuPont Company under the trademark Mylar. Layer 18 has disposed on one of its faces a metalization 20, which would typically take the form of a thin layer of aluminum.

A continuous layer of retro-reflective pigment 22 is, in turn, disposed over the metalization layer 20. The retro-reflective pigment 22 is of the so called "white" variety, that is to say, one which contains substantially no pigment. The layer of retro-reflective pigment 22 is, in turn, protected by a transparent layer 24 which may typically be made of polyvinylchloride or similar transparent material.

Alpha numeric indicia 26 are provided over transparent layer 24. These incidia are composed of a fluorescent pigment layer 28. A suitable pigment is a vinyl screen ink such as that marketed under the trademark Day-Glo "67". This ink is, because of its fluorescent properties, highly contrasting during the day when placed beside the retro-reflective pigment which must be used in order to achieve visibility at night. The entire assembly is protected by a protective layer 30 which may be one of several materials, including, a conventional varnish. Such varnish is transparent, allowing the retro-reflective layer 22 to receive and reflect light through transparent layer 24 and itself while at the same time allowing alpha numeric indicia 26 to be viewed in contrast to the retro-reflective layer 22.

When it is desired to use the material 10 illustrated in FIG. 1 by, for example, adhesion to the sails or hull of a boat, one would first cut the material to remove the desired alphanumeric or other markings without removal of the backing 12 from, perhaps, a large sheet with numerous different designations. In cutting, one should avoid cutting sharp corners or the formation of sharp points. Cutting with a slight curve or radius at the corner will make the material more resistant to accidental peeling. The area to which the material 10 is to be applied should be thoroughly washed with a household detergent and water and then rinsed and allowed to dry. The dry surface should be then wiped with a solvent, such as alcohol. One then peels the backing 12 together with the release agent 14 away from adhesive layer 16 as illustrated in phantom lines in FIG. 1. Because most glues that would typically be employed as adhesive 16 are of the type which make it almost impossible or difficult to repostion the material once it is applied, the material should be applied with care. This can be done by peeling a small area of backing 12 at an edge thereof and by then positioning the material as desired and adhearing it with the exposed edge. The remainder of the backing would then be slowly peeled back exposing the remaining portion of the adhesive layer 16. One would then smoothly adhere the adhesive layer 16 to, for example, a sail of fiberglass body, being careful to avoid trapping air bubbles. In the event that bubbles are created, these can be eliminated by puncturing the blister with a pin and forcing the trapped air out.

The device thus applied to sails has the unique property of being highly visible under a variety of difficult illumination conditions. It can be seen in subdued sunlight, artificial light or on radar. As such it is believed to be of particular importance to reducing dangerous conditions under low visibility for kayaks, canoes, and row boats. As has been discussed above, the safety of these craft depend, in large part, on their ability to be seen or to see each other or to be seen by power boats and by rescuers, if necessary. The inventive materials are thus useful for devices made of wood, fiberglass, Kevlar brand polymeric material, fabric, rubber, and foam. All of these materials have substantially the property of radar transparency.

Figure 2:
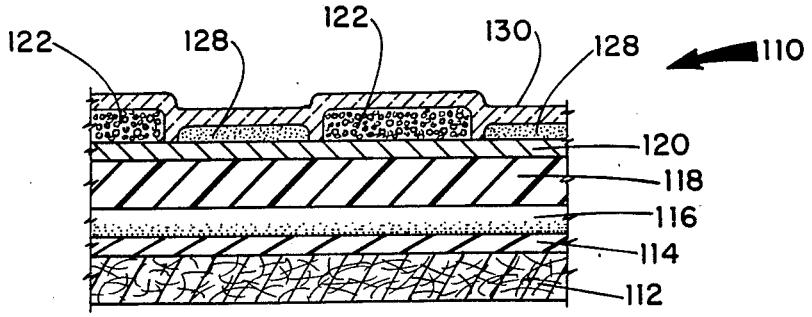
FIG. 2 is a cross-sectional view illustrating the construction of an alternative embodiment of the present invention.

An alternative embodiment of the inventive material 110 is illustrated in FIG. 2. Here a paper backing 112 has secured to it a release agent 114 which, in turn, is removably engaged by adhesive 116. A layer 118 of polymeric material includes a metalized layer 120 which may be, for example, vacuum deposited aluminum. Disposed over the alumminum are stripes of retro-reflective pigment 122 and stripes of fluorescent pigment 128. Finally, a protective layer 130 of varnish or similar material overlies the entire structure.

In use the material of FIG. 2 would be applied after the backing and release agent are removed in much the same matter as the material of FIG. 1.

While illustrative embodiments of the invention have been described, it is, of course, understood that various modifications will be obvious to those of ordinary skill in the art. Such modifications are within these scope of the invention which is limited and defined only the the appended claims.

I claim:

1. A detectable labeling material, comprising:

(a) a layer of adhesive;

(b) a protective member removeably attached to one side of said layer of adhesive;

(c) a polymeric layer permanently attached to the other side of said layer of adhesive;

(d) a conductive material disposed on and in contact with one side of said polymeric layer;

(e) a retro-reflective material disposed over the sandwich comprised of said polymeric material and said conductive layer opposite the side of said sandwich in contact with said adhesive;

(f) a fluorescent material disposed over said sandwich and exposing at least a portion of said retro-reflective material; and (g) a transparent protective layer disposed between said retro-reflective material and said fluorescent material.

2. A detectable labeling material as in claim 1, wherein said retro-reflective material and said flourescent material are disposed over different parts of said polymeric material.

3. A detectable labeling material as in claim 1, wherein said conductive material and said polymeric layer are a metalized layer of Mylar plastic.

4. A detectable labeling material as in claim 1, wherein said retro-reflective material is a pigment incorporating refractive beads.

5. A detectable labeling material as in claim 1, wherein said fluorescent material is a day-glo type pigment.

6. A detectable labeling material as in claim 1, wherein said retro-reflective material contains no pigments.

7. A detectable labeling material as in claim 1, wherein said retro-reflective material is white and said fluorescent material includes a colored fluorescent pigment.

8. A detectable labeling material as in claim 1, further comprising a protective layer disposed over said retro-reflective material and said fluorescent material.

9. A detectable labeling material, comprising:

(a) a layer of adhesive;

(b) a protective member removeably attached to one side of said layer of adhesive;
(c) a polymeric layer permanently attached to the other side of said layer of adhesive;
(d) a conductive material disposed on and in contact with one side of said polymeric layer;
(e) a retro-reflective material disposed over the sandwich comprised of said polymeric material and said conductive layer opposite the side of said sandwich in contact with said adhesive;
(f) a fluorescent material disposed over said sandwich and exposing at least a portion of said retro-reflective material;
(g) a transparent protective layer disposed between said retro-reflective material and said fluorescent material; and
(h) an additional transparent layer disposed on the side of said sandwich bearing said fluorescent material.

10. A detectable labeling material as in claim 9, wherein said support layer and said contactive material are a polymeric material metalized with a layer of aluminum said layer of aluminum being disposed opposite said adhesive layer and further comprising a protective layer disposed over said retro-reflective material, said retro-reflective material comprising a white retro-reflective pigment and further comprising a protective layer disposed over said fluorescent material and said retro-reflective material.

11. A detectable labeling material as in claim 10, wherein said fluorescent material together with said retro-reflective material forms an alphanumeric designation of the type commonly put on a sailboat sail.

12. A detectable labeling material, as in claim 9, wherein said protective member comprises a backing layer permanently secured to a release agent layer, said release agent layer being in contact with said layer of adhesive.

13. A detectable boat sail comprising;
(a) a layer of adhesive;
(b) a boat sail of large area attached to one side of said layer of adhesive;
(c) a small area support layer permanently attached to the other side of said layer of adhesive;
(d) a conductive material disposed and contact with one side of said support layer;
(e) a retro-reflective material disposed over the sandwich comprised of said polymeric material and said conductive layer;
(f) a fluorescent material disposed over said sandwich and exposing at least a portion of said retro-reflective material;
(g) a transparent protective layer disposed between said retro-reflective material and said fluorescent material; and
(h) an additional transparent layer disposed on the side of said sandwich bearing said fluorescent material.

14. A boat sail as in claim 13 wherein said support layer and said conductive material are a polymeric material metalized with a layer of aluminum and further comprising a protective layer disposed over said retro-reflective material, said retro-reflective material comprising a white retro-reflective pigment and further comprising a protective layer disposed over said fluorescent material and said retro-reflective material.

15. A boat sail as in claim 14, wherein said fluorescent material together with said retro-reflective material forms an alpanumeric designation of the type commonly put on a sailboat sail.

* * * * *